US012674290B2

(12) United States Patent
Harding

(10) Patent No.: US 12,674,290 B2
(45) Date of Patent: Jul. 7, 2026

(54) SECURITY SYSTEM

(71) Applicant: UNAFOR LTD, London (GB)

(72) Inventor: Michael Hamish Harding, Vaerlose (DK)

(73) Assignee: UNAFOR LTD, London (GB)

( * ) Notice: Subject to any disclaimer, the term of this patent is extended or adjusted under 35 U.S.C. 154(b) by 524 days.

(21) Appl. No.: 18/264,039

(22) PCT Filed: Feb. 4, 2022

(86) PCT No.: PCT/EP2022/052673
§ 371 (c)(1),
(2) Date: Aug. 2, 2023

(87) PCT Pub. No.: WO2022/167564
PCT Pub. Date: Aug. 11, 2022

(65) Prior Publication Data

US 2024/0150981 A1 May 9, 2024

(30) Foreign Application Priority Data

Feb. 5, 2021 (EP) ..... 21155487

(51) Int. Cl.
*E01F 13/12* (2006.01)

(52) U.S. Cl.
CPC ..... *E01F 13/12* (2013.01)

(58) Field of Classification Search
CPC . E01F 13/12; E01F 9/685; E01F 13/00; E01F 13/024; E01F 13/026; E01F 15/00;
(Continued)

(56) References Cited

U.S. PATENT DOCUMENTS 7,699,558 B2 * 4/2010 Adler ..... E01F 13/00 404/6
7,850,391 B2 * 12/2010 Omar ..... E01F 13/12 404/6

(Continued)

FOREIGN PATENT DOCUMENTS

EP 3441527 A1 2/2019
EP 3495560 A2 6/2019

(Continued)

OTHER PUBLICATIONS

Extended European Search Report from corresponding EP Application No. 21155487.8, Jul. 9, 2021.

(Continued)

*Primary Examiner* — Abigail A Risic
(74) *Attorney, Agent, or Firm* — Workman Nydegger

(57) ABSTRACT

A security system provides a barrier above a ground level, and includes a first support element extending in a first direction and a second support element extending in a second direction. The security system further has an elongated carrier element extending in a third direction, where the third direction is transverse to the first direction and the second direction. The first support element and the second support element are attached to a lower surface of the elongated carrier element to provide support for the elongated carrier element, where both the first support element and the second support element extend away from the elongated carrier element on opposite sides of the elongated carrier element. The security system further includes a removable stanchion extending upwardly from an upper surface of the elongated carrier element from a point below ground level to a point above ground level.

18 Claims, 7 Drawing Sheets

(58) Field of Classification Search
CPC ..... E01F 15/0461; E01F 15/0476; E01F 15/0484; E01F 15/146
See application file for complete search history.

(56) References Cited

U.S. PATENT DOCUMENTS

| | | | | |
|---|---|---|---|---|
| 10,988,903 | B1 * | 4/2021 | Neusch | E01F 15/003 |
| 11,499,279 | B1 * | 11/2022 | Lamore | E01F 9/685 |
| 11,578,468 | B1 * | 2/2023 | Kramps | E01F 9/685 |
| 12,173,460 | B2 * | 12/2024 | Neusch | E01F 15/003 |
| 2006/0090408 | A1 * | 5/2006 | Darcy | E01F 13/12 52/174 |
| 2007/0086858 | A1 * | 4/2007 | Morgan | E01F 13/12 404/6 |
| 2009/0028638 | A1 * | 1/2009 | Crawford | E01F 13/12 404/6 |
| 2021/0222382 | A1 * | 7/2021 | Neusch | E01F 13/12 |
| 2021/0348359 | A1 * | 11/2021 | Messelis | E02D 27/42 |
| 2024/0328100 | A1 * | 10/2024 | Vidamo | E01F 9/658 |

FOREIGN PATENT DOCUMENTS

| | | | |
|---|---|---|---|
| EP | 3623531 | A1 | 3/2020 |
| GB | 2493353 | A | 2/2013 |
| GB | 2580716 | A | 7/2020 |
| WO | 2007001326 | A2 | 1/2007 |
| WO | 2007091977 | A1 | 8/2007 |
| WO | 2019116200 | A2 | 6/2019 |
| WO | 2020201687 | A1 | 10/2020 |

OTHER PUBLICATIONS

International Search Report from corresponding PCT Application No. PCT/EP2022/052673, May 10, 2022.
International Preliminary Report on Patentability from corresponding PCT Application No. PCT/EP2022/052673, May 22, 2023.

* cited by examiner

SECURITY SYSTEM

FIELD OF THE INVENTION

The present invention relates to security system providing a barrier above a ground level for hostile vehicle mitigation.

BACKGROUND OF THE INVENTION

To protect pedestrians and/or certain areas of a city, different types of protection systems are used. A simple system often comprises one or more concrete blocks arranged on the ground. Another typical system comprises one or more concrete blocks arranged below ground level as foundations. A pillar is attached to each concrete block. To provide sufficient strength these concrete blocks must be of a considerably size, thereby requiring heavy digging.

A vehicle barrier is disclosed in prior art document GB 2493353. The barrier comprises a first support, a separate second support; a flexible coupling which is attached to the first support, and a bridging arm which supports the flexible coupling. The second support is rigidly joined to the first support by a pair of parallel base beams. The bridging arm is moveably attached to the first support and the second support. The bridging arm may be frangible in an impact and variable in length telescopically. The flexible coupling may be a rope, cable, wire or chain and is preferably nylon braided rope. In use the flexible coupling is adapted to absorb vehicular impact energy.

GB 2580716 discloses a removable bollard system comprises an underground footing for installation in the ground, the footing having an upper section with a recess. An impact post is locatable in the footing, and a shroud is located over the post, the shroud having a lower end receivable in the recess. A cover plate also receivable in the recess is interchangeable with the post and shroud. The lower end of the shroud may be substantially the same depth as the recess and may comprise upper and lower base plates with spacers between them. The footing may comprise an upright tubular section in which the post is received.

DESCRIPTION OF THE INVENTION

It is an object of embodiments of the invention to provide an improved security system providing a barrier and an improved method of constructing a barrier.

According to a first aspect, the invention provides a security system providing a barrier above a ground level, the security system comprising:

- a first support element extending in a first direction;
- a second support element extending in a second direction, the first support element and the second support element being substantially plate-shaped, and being arranged below ground level;
- an elongated carrier element extending in a third direction, the third direction being transverse to the first direction and the second direction, wherein the first support element and the second support element are attached to a lower surface of the elongated carrier element to provide support for the elongated carrier element, both the first support element and the second support element extending away from the elongated carrier element on opposite sides of the elongated carrier element, the elongated carrier element being arranged below ground level, wherein the first support element, the second support, and the elongated carrier element are covered by at least one cover material; and

- at least one elongated stanchion extending upwardly from an upper surface of the elongated carrier element from a point below ground level to a point above ground level, wherein the at least one stanchions is removably attached to the elongated carrier element.

The first support element, the second support element, and the elongated carrier element are arranged below ground level. To achieve this a hole may be provided in the ground. To facilitate positioning of the security system the bottom of the hole may be substantially flat and may preferable be substantially horizontal.

The first support element and the second support element are attached to a lower surface of the elongated carrier element to provide support for the elongated carrier element. The first support element and the second support element may be arranged on the bottom of the hole thereby providing a support for the elongated carrier element. By providing the first and second support element as plate-shaped elements; i.e. as substantially flat elements, positioning hereof on the bottom of the hole may be facilitated. The first support element and the second support element may be attached to the elongated carrier element to form a single element prior to positioning of this element.

The first support element extends in a first direction, whereas the second support element extends in a second direction. An angle between the first direction and the second direction may be in the range of 0-30 degrees, such as 0-20 degrees, such as 0-10 degrees. In one embodiment, the first direction and the second direction may be substantially parallel.

The elongated carrier element extends in a third direction, where the third direction is transverse to the first direction and the second direction. An angle between the third direction and at least one of the first direction and the second direction may be in the range of 45-90 degrees, such as in the range of 60-90 degrees. In one embodiment, the third direction may be substantially perpendicular to at least one of the first and the second directions.

At least one elongated stanchion extends upwardly from an upper surface of the elongated carrier element from a point below ground level to a point above ground level. Thus, the at least one elongated stanchion may extend between a lower end part and an opposite upper end part, where the lower end part of the stanchion is arranged below ground level and the upper end part is arranged above ground level. In an embodiment comprising two elongated stanchions, the stanchions may preferably be arranged at opposite ends of the elongated carrier element.

The at least one stanchion is removably attached to the elongated carrier element. In one embodiment, the at least one stanchion is attached to the elongated carrier element before the elongated carrier element is arranged below ground level. In an alternative embodiment, the at least one stanchion is attached to the elongated carrier element after the elongated carrier element is arranged below ground level.

By providing the security system with at least one upwardly extending elongated stanchion, this stanchion may be used to stop a vehicle driving against the security system to collied into the security system.

As specified above, the first support element, the second support, and the elongated carrier element are arranged below ground level. The first support element, the second support, and the elongated carrier element are covered by at least one cover material. By providing a cover material on the first and second support elements and on the elongated carrier element, the security system can be kept substantially in place, if a vehicle is forced to collide with the system.

By providing the first and second support members as substantially plate-shaped elements, where both the first support element and the second support element extend away from the elongated carrier element on opposite sides of the elongated carrier element, the depth of the hole for the first support element, the second support, and the elongated carrier element being arranged below ground level may be considerably reduced, as the area of the support element which can be covered by the cover material may be increased compared to traditional barriers. As an example, the length of the first and the second support members may be three times the width of the elongated carrier element. Consequently, the amount of cover material may likewise be reduced, while still providing a security system capable of withstanding an impact of a vehicle. The depth of the hole for the first support element, the second support, and the elongated carrier element may as an example be less than 300 mm, such as less than 250 mm.

Thus, the amount of cover material, e.g., in the form of concrete may be considerably reduced compared to a traditional barrier system, where concrete blocks are arranged below ground level as foundations, and a pillar is attached to the concrete block.

A number of security system may be arranged at one site next to each other to provide a larger security installation where each security system may form a module of the larger security installation to thereby be able to protect a larger area. The modular design may allow for each transportation and flexible design. One security system may be arranged at a distance to a neighbouring security system, where the distance is small enough to avoid a vehicle to pass between the two neighbouring security systems. In one embodiment of a security installation, at least two neighbouring security system may be arranged in contact with each other.

The first support element may extend between a first support end and an opposite second support end in the first direction. By providing the first support element with a support length being the dimension between the first support end and the second support end being larger than the dimension of the carrier element along the first direction, the first support element extends beyond the carrier element in the first direction. Thus, the first support element extends away from the elongated carrier element on opposite sides of the elongated carrier element to thereby provide an increased support for the carrier element. The first support element may counteract a force having a substantial horizontal component acting on the carrier element, e.g., via the at least one stanchion to thereby reduce the risk of the carrier element being tilted by the applied force.

Similarly, the second support element may extend between a first support end and an opposite second support end in the second direction. By providing the second support element with a support length being the dimension between the first support end and the second support end being larger than the dimension of the carrier element along the second direction, the second support element extends beyond the carrier element in the second direction. Thus, the second support element extends away from the elongated carrier element on opposite sides of the elongated carrier element to thereby provide an increased support for the carrier element.

By use of a first support element and a second support element extending beyond the elongated carrier element in the first direction and the second direction, concrete blocks of a considerably size used as fundaments and heavy digging may be avoided. The hole may be provided with a depth so that only the first support element, the second support element, and the elongated carrier element are arranged below ground level. An additional depth for a foundation below the first support element, the second support element, and the elongated carrier element is not necessary.

At least one of the first direction, the second direction, and the third direction may be substantially horizontal, such as in the range of +/−15 degrees to horizontal, such as in the range of +/−10 degrees to facilitate installation of the security system.

The at least one elongated stanchion extends upwardly from an upper surface of the elongated carrier element. In one embodiment, the at least one elongated stanchion may extend substantially vertical, such as in the range of +/−15 degrees to vertical, such as in the range of +/−10 degrees.

The first support element and the second support element are substantially plate-shaped. The first and second support elements may have a support thickness being a distance from a lower surface facing downwards to an upper surface facing upwards and at which the elongated carrier element is attached, a support width being transverse to the support thickness, and a support length along the first direction and/or the second direction, the support length being transverse to the support thickness and support width. As specified above, the support length may be the distance between a first support end and a second support end.

By a substantially plate-shaped element should be understood, a substantially flat element where the support width and the support length are considerably larger than the support thickness. In a preferred embodiment, the first and second elements, each forms a substantially square-shaped flat element defined by the support width and support length. It should however be understood that the shape of the first support element and/or second element are not limited hereto. As an example, the first and or second support element may be oval where the support width and the support length denote the longest dimension in the two longest dimensions. In another embodiment, the corners of the first and second support elements may be cut-off to provide a first and/or second support element being substantially octagonal. The first support element and/or the second support element may thus form an arbitrary shape where the support width and the support length refer to the two longest dimensions in substantially perpendicular directions.

The elongated carrier element may be attached to the first and second support elements along at least 50% of the support width, such as at least 75% of the support width, such as at least 90% of the support width. In one embodiment, the first and second support elements may be arranged at opposite ends of the elongated carrier element so that a first carrier end is supported by the first support element being attached to the lower surface of the carrier element at the first carrier end and where a second carrier end is supported by the second support element being attached to the lower surface of the carrier element at the second carrier end.

The first and second support elements may be made of metal, such as steel, and may in one embodiment have a support thickness in the range of 5-70 mm, such as 10-50 mm, such as 15-30 mm. The thickness may as an example depend on the size of the security system, the selected material, and/or the force which the security system should be able to withstand.

In one embodiment, the support length may be at least twice the support width, such as at least 2.5 times the support width, such as three times the support width, or even larger. In one embodiment, the support length may be in the range of 600-2000 mm, such as 750-1500 mm, such as 800-1200 mm. In one embodiment, the support width may be in the range of 200-800 mm, such as 250-700 mm, such as 300-600 mm.

The support width may be at least ten times the support thickness, such as at least 15 times the support thickness, such as 20 times the support thickness, or even more.

The elongated carrier element may be substantially box-shaped, and the elongated carrier element may have a carrier thickness being a distance from the lower surface being attached to the first and second support elements to the opposite upper surface of the carrier element, a carrier width being transverse to the carrier thickness, and a carrier length along the third direction, the carrier length being transverse to the carrier thickness and carrier width.

The carrier length may in one embodiment be at least five times the carrier width. In one embodiment, the carrier length may be in the range of 1200-3000 mm, such as 1400-2500 mm, such as 1500-2200 mm. In one embodiment, the carrier width may be in the range of 100-500 mm, such as 125-400 mm, such as 150-250 mm. The carrier thickness may likewise be in the range of 100-500 mm, such as 125-400 mm, such as 150-250 mm.

By substantially box-shaped should be understood, that the elongated carrier element in a cross-second forms a substantially rectangular form. In one embodiment, the cross-section may be substantially quadratic. The carrier width may be in the range of 0.5-1.5 the carrier thickness.

Both the first support element and the second support element extend away from the elongated carrier element on opposite sides of the elongated carrier element. This is achieved by providing the first support element and second support element with a support length being larger than the carrier width of the elongated carrier element. The support length may be three times, such as four times, such as five times or even more larger than the carrier width.

The at least one elongated stanchion may be substantially box-shaped, and the elongated stanchion may have a stanchion thickness being a dimension in the first direction, a stanchion width being transverse to the first direction, and a stanchion length being transverse to the stanchion thickness and stanchion width, where the stanchion length may also be referred to as the stanchion height.

The stanchion length may be at least three times, such as four times, or more, the stanchion width. In one embodiment, the stanchion length may be in the range of 400-2000 mm, such as 500-1500 mm, such as 600-1000 mm. In one embodiment, the stanchion width may be in the range of 50-200 mm, such as 75-175 mm, such as 100-150 mm.

By substantially box-shaped should be understood, that the elongated stanchion in a cross-second forms a substantially rectangular form. In one embodiment, the cross-section may be substantially quadratic. The stanchion width may be in the range of 0.4-1.8 the stanchion thickness.

As described above, the application of first and second support members in the form of substantially plate-shaped elements, both extending away from the elongated carrier element on opposite sides hereof, the depth of the hole for the first support element, the second support, and the elongated carrier element may be considerably reduced, whereby the amount of cover material may likewise be reduced, while still providing a security system capable of withstanding an impact of a vehicle. In one embodiment, the carrier thickness may be in the range of 15-25 percent of the stanchion length, such as in the range of 17-22 percent.

The elongated carrier element and the at least one stanchion may be made of metal, such as steel, or of a material with similar strength.

The at least one elongated stanchion may be formed as a hollow structure with a wall thickness of at least 10 mm. By providing the stanchion(s) as hollow structure(s), it may be possible to lower the weight while having a high strength relative to impact on the stanchions form a horizontal force component, e.g., from a vehicle colliding with the security system. The wall thickness may as an example depend on the required strength of the security system, e.g., depend on the travelling speed of a vehicle which the security system should be able to withstand.

To increase the strength of the security system, at least one stiffening rib may be arranged in the hollow structured formed by the at least one elongated stanchion. The at least one stiffening rib may be a plate-shaped rib arranged transverse to the third direction. In one embodiment, the at least one stiffening rib may be arranged perpendicular to the third direction. In one embodiment two or more ribs may be arranged. The two or more ribs may be arranged parallel to each other.

By a substantially plate-shaped rib should be understood, a substantially flat element having a width and a length being considerably larger than the thickness of the rib. The thickness of the at least one stiffening rib may be in the range of the wall thickness of the stanchion in which the at least one stiffening rib is arranged.

The at least one stiffening rib may extend along the stanchion length from a bottom part of the stanchion to a top part of the stanchion, such as along the full length of the stanchion.

The elongated carrier element formed may be a hollow structure with a wall thickness of at least 10 mm.

In one embodiment, at least two openings may be formed in the upper surface of the elongated carrier element, and a bottom end of one of the at least one elongated stanchion may be inserted in one of the at least two openings. Thus, a stanchion may be inserted one opening or a stanchion may be inserted in each of the openings. It should be understood, that one stanchion may be inserted in one opening, leaving the other opening empty. The security system may comprise a closing structure configured to close an opening in which a stanchion is not inserted.

The at least two openings may have a shape matching the outer shaped of the elongated stanchions in a cross-section transverse to the length of the stanchions. This may facilitate insertion of the bottom end of the stanchion into the opening. The security system may further comprise a locking structure configured to lock one of the at least one elongated stanchion when inserted into one of the at least two openings.

As specified above, the first support element, the second support, and the elongated carrier element are arranged below ground level and covered by at least one cover material. The cover material may be of a sufficient amount to fill the hole in which the first support element, the second support, and the elongated carrier element may be arranged.

In one embodiment, the at least one cover material may comprise concrete. Concrete may be the sole cover material. However, in an alternative embodiment, the cover material may comprise concrete and at least one additional cover material. The additional cover material may as an example be a granular material, such as gravel or similar.

The granular material may be stamped, vibrated, or otherwise treated to ensure it is compact, and to ensure that the upper level is substantially flush with the surrounding ground level.

In one embodiment, concrete may be used as a first cover material. As an example, approximately half of the hole may be filled with concrete. Concrete may be poured into the hole to cover at least the first support element, the second support, and the elongated carrier element such that the height of the concrete of in the range of 35-75% of the total height of the hole. It should, however, be understood that concrete may be the only cover material, whereby the height of the concrete may be up to 100% of the height of the hole in which the first support element, the second element, and the elongated carrier element are arranged.

In an embodiment, where concrete is used as a first cover material, a second cover material may be arranged on top of the concrete. Preferably, the concrete may be allowed to cure before arranging the second cover material on the layer of concrete.

A socket may be arranged along the inner surface of the openings formed in the upper surface of the elongated carrier element, which socket may extend upwardly out from the opening to a point substantially at ground level or to a point above the planned upper level of a cover material, such as a first cover material, being concrete. When the socket is arranged along the inner surface before concrete is arranged to cover the first support element, the second support element, and the elongated carrier element, it may be possible to remove a stanchion inserted in an opening comprising a socket even after the concrete has cured. The socket may be made of a metal, such as steel, a polymer, or another suitable material capable of separating the concrete and the stanchions. In embodiments where the stanchion(s) is(are) inserted before concrete in arranged to cover the first support element, the second support element, and the elongated carrier element, the socket may be made of a flexible material, as an inner surface of the socket may be supported by the stanchion to thereby keep the socket in place during the process of arranging the concrete.

At least one protrusion may be formed at an outer surface of the elongated carrier element, the at least one protrusion extending transverse to the third direction. The at least one protrusion may be arranged to increase the frictional forces between the elongated carrier element and the at least one cover material, such as the adherence of concrete to the elongated carrier element. The at least one protrusion may be attached a side wall of the elongated element, where a first and a second side wall may extend between the upper and the lower surface of the elongated carrier element to provide a box-shaped carrier element.

To further increase the frictional forces, a pair of protrusions may extend in opposite directions from the outer surface of the elongated carrier element. It should be understood, that one, two, three, four, or even more protrusions may extend form an outer surface of the elongated carrier element. It should be understood, that protrusions may preferably be attached to the side walls. However, a protrusion may alternatively or additionally be attached to the upper surface of the elongated carrier element.

The first support element and the second support element may comprise upwardly extending stiffening elements, where the stiffening elements may be arranged to engage an outer surface of the elongated carrier element to reinforce a joint between the elongated carrier element and the first and second support elements, respectively. In one embodiment, at least one stiffening element may be attached to the upper surface of the first support element along a first edge portion of the stiffening element. A second edge portion of the stiffening element may be attached to the elongated carrier element. The first side edge and the second side edge may extend in different directions from a corner of the stiffening element. In one embodiment, the angle between the first side edge and the second side edge may be substantially 90 degrees, such as in the range of 80-100 degrees.

At least one stiffening element may likewise be attached to the upper surface of the second support element along a first edge portion of the stiffening element. A second edge portion of the stiffening element may be attached to the elongated carrier element. The first side edge and the second side edge may extend in different directions from a corner of the stiffening element. In one embodiment, the angle between the first side edge and the second side edge may be substantially 90 degrees, such as in the range of 80-100 degrees.

In one embodiment, at least one of the first support element and the second support element may comprise at least two stiffening elements, where a first stiffening element may be arranged to engage the outer surface of the elongated carrier element at one side and where a second stiffening element may be arranged to engage the outer surface of the elongated element at an opposite side, i.e. at opposite side wall of the elongated carrier element.

The security system may comprise an attachment structure to allow attachment of a secondary element to the security system, where the secondary element as an example may be at least one of planter trays, benches, bike racks, lighting posts, etc.

The attachment structure may be formed at an outer surface of the security system, such as on an outer surface at least one stanchion.

According to a second aspect, the invention provides a method of constructing a barrier above ground by use of a security system according to the first aspect; the method comprising the step of:

- providing a first support element, a second support element, the first and second support elements being substantially plate-shaped, and an elongated carrier element;
- arranging the first support element to extend in a first direction, arranging the second support element to extend in a second direction, and arranging the elongated carrier element to extend in a third direction being transverse to the first direction and the second direction;
- attaching the first support element and the second support element to a lower surface of the elongated carrier element so that both the first support element and the second support element extend away from the elongated carrier element on opposite sides of the elongated carrier element;
- arranging the first support element, the second support element, and the elongated carrier element below ground level;
- providing at least one elongated stanchion;
- removably attaching the at least one stanchion to the elongated carrier element so that the at least one stanchion extend upwardly from an upper surface of the elongated carrier element from a point below ground level to a point above ground level; and covering the first support element, the second support element, and the elongated carrier element by at least one cover material.

It should be understood, that a skilled person would readily recognise that any feature described in combination with the first aspect of the invention could also be combined with the second aspect of the invention, and vice versa.

The method according to the second aspect of the invention is very suitable for construction the security system according to the first aspect of the invention. The remarks set forth above in relation to the security system are therefore equally applicable in relation to the method.

It should be understood, that the method step may be carried out in another order, e.g. by arranging the first support element, the second support element, and the elongated carrier element below ground level before attaching the first support element and the second support element to a lower surface of the elongated carrier element.

Likewise, may the at least one stanchion be removably attached to the elongated carrier element before the first support element, the second support element, and the elongated carrier element are arranged below ground level.

The method may comprise a further step of covering the first support element, the second support element, and the elongated carrier element by an additional cover material.

According to a third aspect, the invention provides a security assembly for use in a security system according to any of the preceding claims, the security assembly comprising a first support element being substantially plate-shaped;

a second support element being substantially plate-shaped;

an elongated carrier element configured for attachment to the first support element and the second support element at a lower surface of the elongated carrier element; and at least one elongated stanchion configured for attachment to an upper surface of the elongated carrier element to extend upwardly from the upper surface, wherein the at least one stanchion is configured for removable attachment to the elongated carrier element.

It should be understood, that a skilled person would readily recognise that any feature described in combination with the first aspect and the second aspect of the invention could also be combined with the third aspect of the invention, and vice versa. The remarks set forth above in relation to the security system and the method are therefore equally applicable in relation to the security assembly.

The security assembly may further comprise an additional elongated stanchion, where the additional elongated stanchion may have a different strength than the at least one elongated stanchion to thereby provide a security system with variable strength dependent on the type of elongated stanchion(s) attached to the elongated carrier element.

The additional elongated stanchion(s) may as an example be provided with a wall thickness being larger than the wall thickness of the elongated stanchion(s), to thereby provide additional stanchion(s) with increased strength. In an alternative embodiment, the additional elongated stanchion(s) may be solid. In a further alternative, the additional stanchion(s) may be provided with a stiffening structure on an outer surface and/or one or more stiffening ribs in a hollow structure. It should be understood, that a stiffening structure on the outer surface may addition be combined with a larger wall structure and/or a solid structure to further increase the strength.

BRIEF DESCRIPTION OF THE DRAWINGS

Embodiments of the invention will now be further described with reference to the drawings, in which.

DETAILED DESCRIPTION OF THE DRAWINGS

It should be understood that the detailed description and specific examples, while indicating embodiments of the invention, are given by way of illustration only, since various changes and modifications within the spirit and scope of the invention will become apparent to those skilled in the art from this detailed description.

Figure 1:
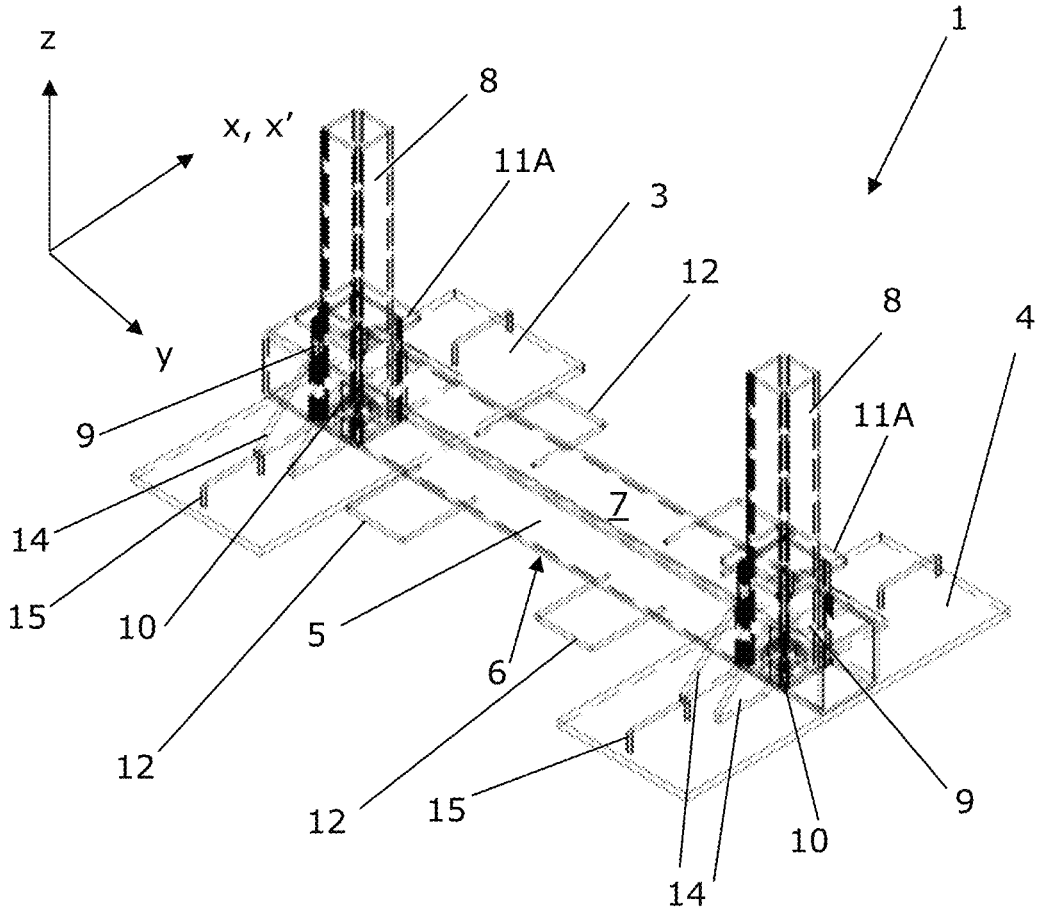
FIG. 1 illustrates an isometric presentation of an embodiment of a security system.
Figure 5:
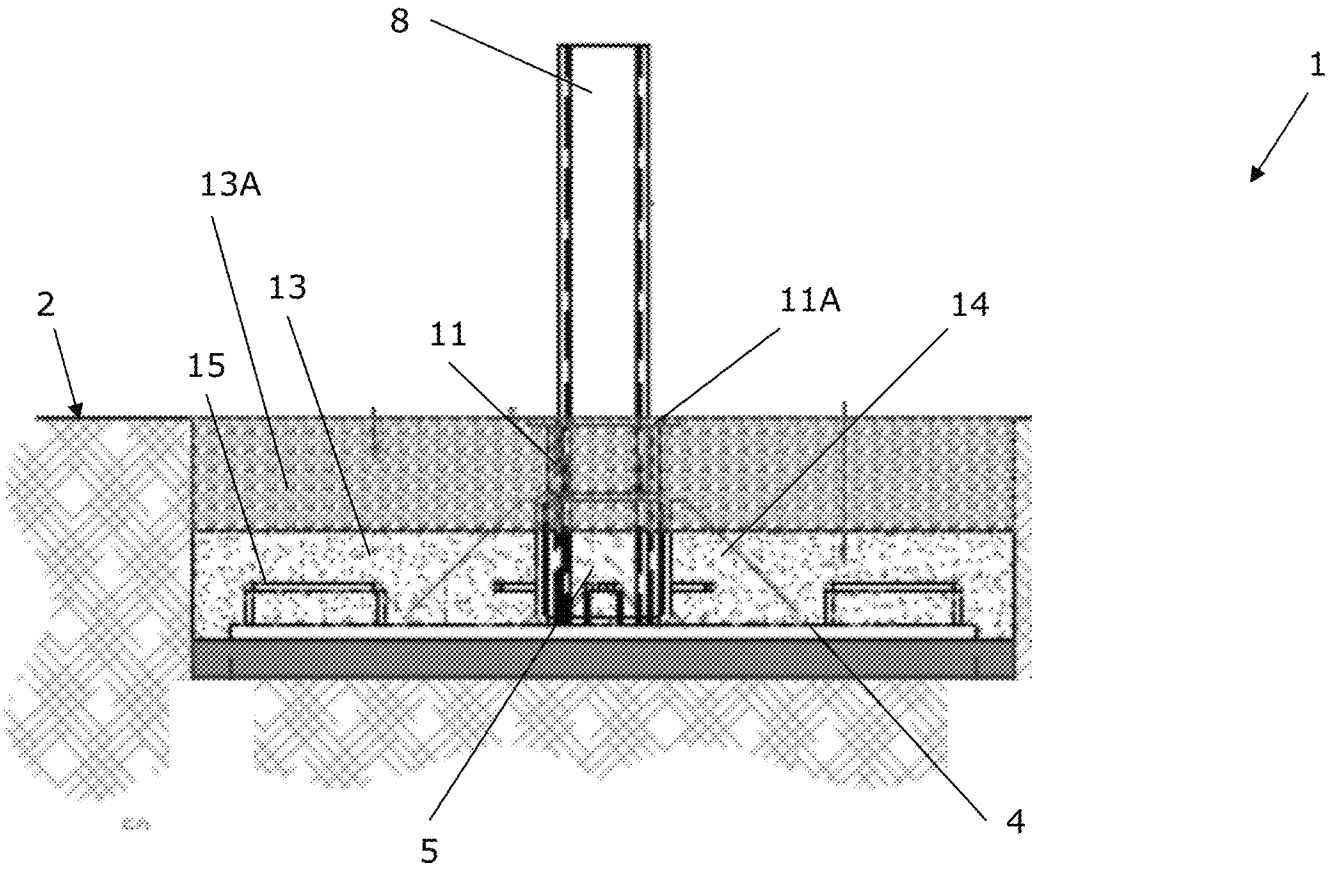
FIG. 5 illustrates an end view of an embodiment of a security system.

FIG. 1 illustrates an isometric presentation of an embodiment of a security system 1 providing a barrier above a ground level 2 (see FIG. 5). The security system 1 comprises a first support element 3 being substantially plate-shaped and extending in a first direction x, a second support element 4 being substantially plate-shaped and extending in a second direction x'. In the illustrated embodiment, as the first direction x and the second direction x' are substantially identical. The first support element 3 and the second support element 4 are arranged below ground level 2 (see FIG. 5).

The security system 1 further comprises an elongated carrier element 5 extending in a third direction y, where the third direction y is transverse to the first direction x and the second direction x'. In the illustrated embodiment, the third direction y is substantially perpendicular to the first and the second direction x, x'.

The first support element 3 and the second support element 4 are attached to a lower surface 6 of the elongated carrier element 5 to provide support for the elongated carrier element 5, where the lower surface 6 faces downwards and an opposite upper surface 7 of the elongated carrier element faces upwards. The elongated carrier element 5 is arranged below ground level 2 (see FIG. 5).

The security system 1 further comprises two elongated stanchions 8 which extend upwardly along the z direction from the upper surface 7 of the elongated carrier element 5 from a point below ground level to a point above ground level. The two stanchions 8 are removably attached to the elongated carrier element 5. It should be understood, that the security system in an alternative embodiments comprises a single elongated stanchion.

In the illustrated embodiment, the first support element 3 and the second support element 4 are formed by steel and are substantially plate-shaped. Both the first support element 3 and the second support element 4 extend away from the elongated carrier element 5 on opposite sides of the elongated carrier element 5 to thereby provide an increased support for the carrier element 5. The first and second support elements 3, 4 may counteract a force having a substantial horizontal component acting on the carrier element 5, e.g., via the stanchions 8 to thereby reduce the risk of the carrier element 5 being tilted by the applied force.

In the illustrated embodiment, the elongated carrier element 5 and the two elongated stanchions 8 are substantially box-shaped; i.e. they have a cross-section being substantially shaped as a square.

To openings 9 are formed in the upper surface 7 of the elongated carrier element 5, and a bottom end 10 of one of the stanchions 8 is inserted in one of the openings 10, whereas the bottom end 10 of the other stanchion 8 is inserted in the other opening 10.

The two openings 9 have an inner shape matching the outer shaped of the elongated stanchions 8 in a cross-section transverse to the length of the stanchions 8 to facilitate insertion of the bottom end 10 of the stanchions 8 into the openings 9.

A socket 11 is arranged along the inner surface of each of the openings 9. The sockets 11 extend upwardly out of the openings 9 to a point above ground level 2 (see FIG. 5). The sockets 11 are terminated at an outwardly extending edge portion 11A.

Two pairs of protrusions 12 extend in opposite directions from the outer surface of the elongated carrier element 5, form the side walls of the carrier element. The protrusions 12 extend transverse to the third direction y. The protrusions 12 are arranged to increase the adherence of a cover material 13 (see FIGS. 2 and 5) in the form of concrete to the elongated carrier element 5.

In the illustrated embodiment, the first support element 3 and the second support element 4 each comprises four upwardly extending stiffening elements 14, where the stiffening elements 14 are arranged to engage the outer surface of the elongated carrier element 5 to reinforce a joint between the elongated carrier element 5 and the first and second support elements 3, 4, respectively. In the illustrated embodiment, the stiffening element 14 are plate-shaped with a triangular form.

The stiffening elements 14 are attached to the upper surface of the first support element 3 and the second support element 4, respectively, along a first edge portion of the stiffening element 14. A second edge portion of the stiffening element 14 is attached to the elongated carrier element 5. The first side edge and the second side edge of the stiffening element extend in different directions from a corner of the stiffening element. In addition to reinforcing the joint between the elongated carrier element 5 and the first support element 3 and the second support element 4, respectively, the stiffening elements 14 increase the adherence of a cover material 13.

In the illustrated embodiment, the first support element 3 and the second support element 4 each comprises two upwardly extending handling elements 15, where the handling elements 15 are arranged to facilitate handling of the first and second support elements 3, 4. The handling elements 15 form an opening to facilitate handling. In addition to facilitate handling of the first support element 3 and the second support element 4, respectively, the handling elements 15 increase the adherence of a cover material 13.

Figure 2:
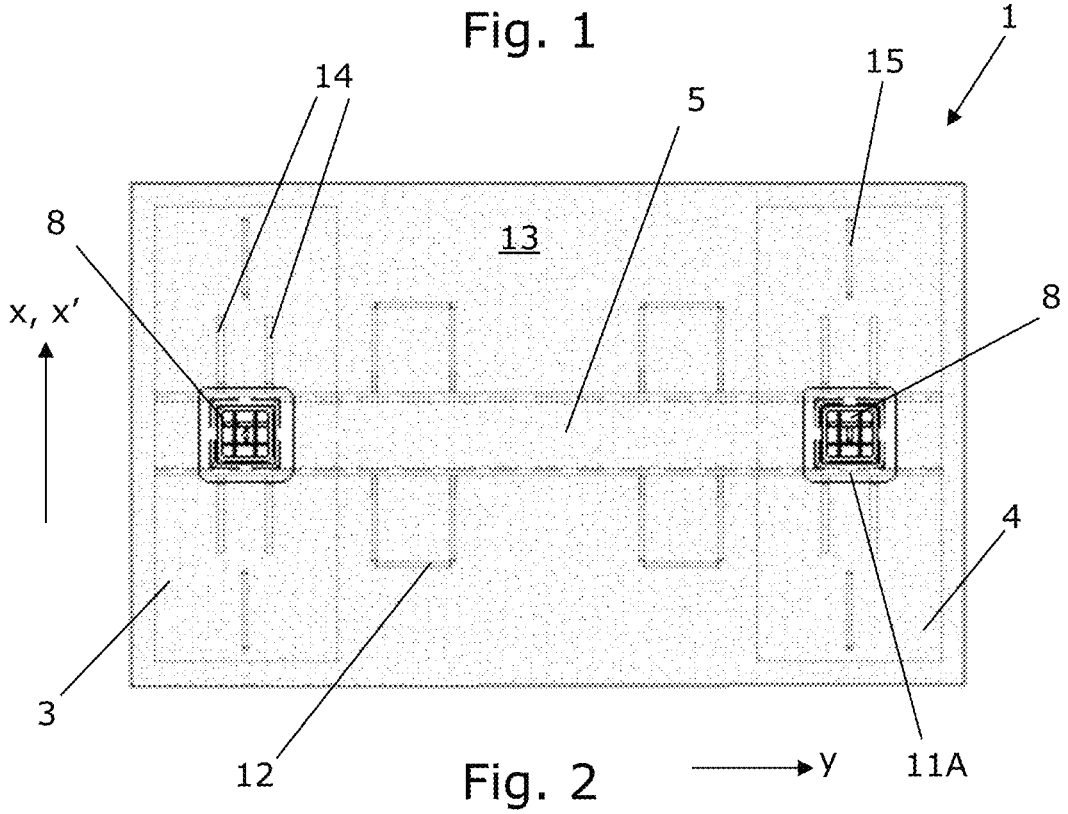
FIG. 2 illustrates a top view of an embodiment of a security system.

FIG. 2 illustrates a top view of the security system 1 illustrated in FIG. 1. As described above, the first support element 3, the second support 4, and the elongated carrier element 5 are arranged below ground level and are covered by a first cover material 13 in the form of concrete. An additional cover material 13A in the form of gravel is subsequently arranged on top of the concrete (see FIG. 5).

Figure 3:
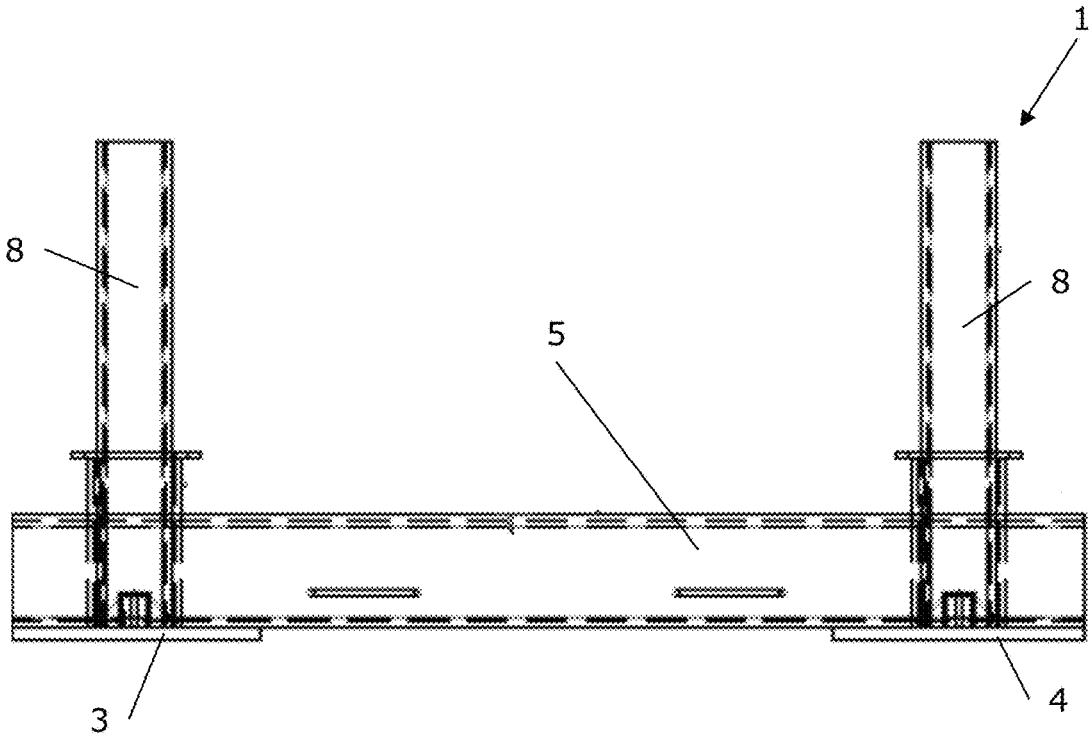
FIG. 3 illustrates a side view of an embodiment of a security system.
Figure 4:
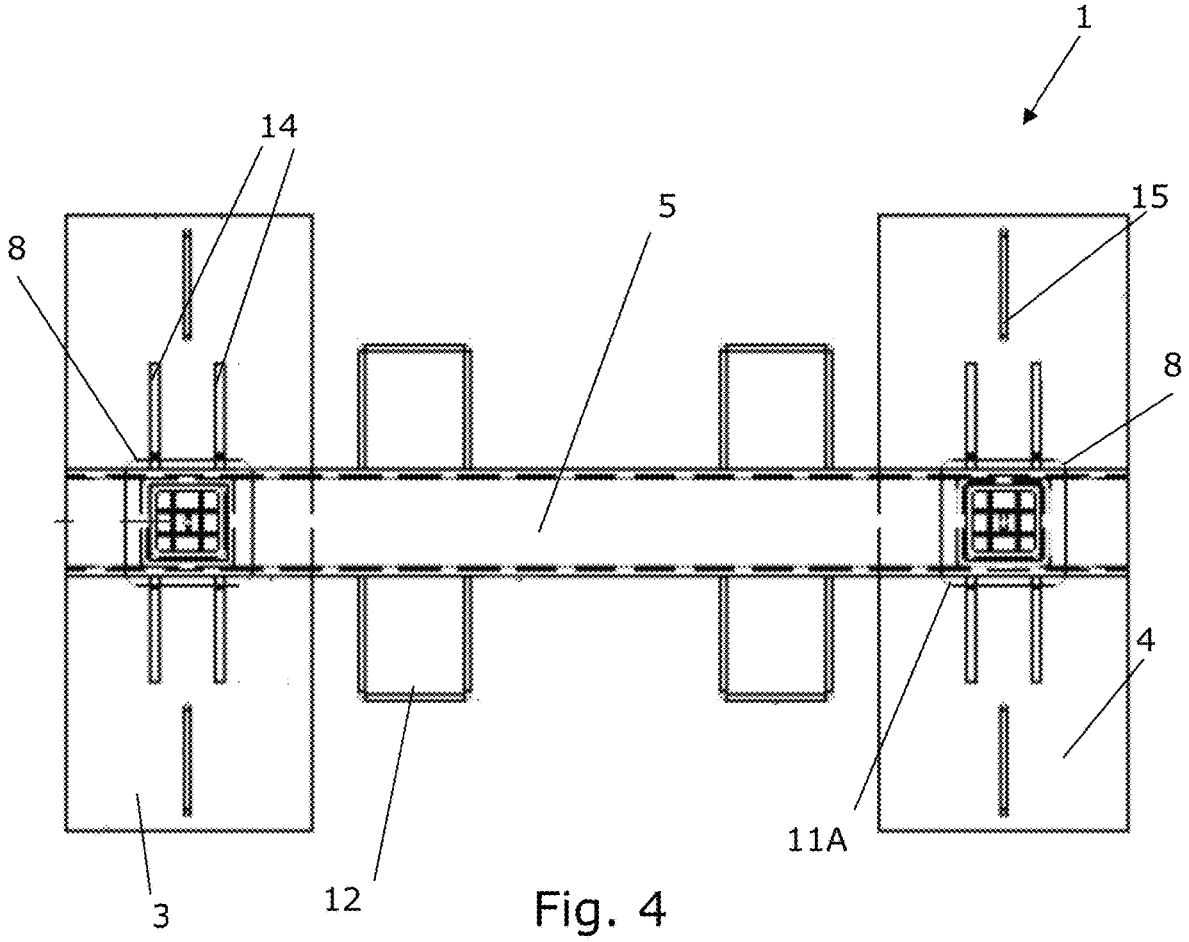
FIG. 4 illustrates a top view of an embodiment of a security system.

FIG. 3 illustrates a side view and FIG. 4 a top view of the security system 1 illustrated in FIGS. 1 and 2. FIG. 4 is similar to FIG. 2 with the exception, that the cover material in the form of concrete is not illustrated in FIG. 4.

FIG. 5 illustrates an end view of the security system 1 illustrated in FIGS. 1-4. As described above, the first support element 3, the second support 4, and the elongated carrier element 5 are arranged below ground level. The first support element 3, the second support 4, and the elongated carrier element 5 are covered by a first cover material 13 in the form of concrete. An additional cover material 13A in the form of gravel is subsequently arranged on top of the concrete. The additional cover material is arranged so that the upper surface hereof is substantially flush with the ground level 2.

The socket 11 being arranged along the inner surface of each of the openings 9 in the elongated carrier element 5 extend upwardly out of the openings 9. The sockets 11 are terminated at an outwardly extending edge portion 11A which is substantially flush with ground level 2. When the cover material in the form of concrete 13 has hardened, and the additional cover material in the form of gravel is in a compact form, it is still possible to remove the stanchion(s) 8, since it/they is/are attached to the elongated carrier element 5 via the socket(s) 11.

Figure 6:
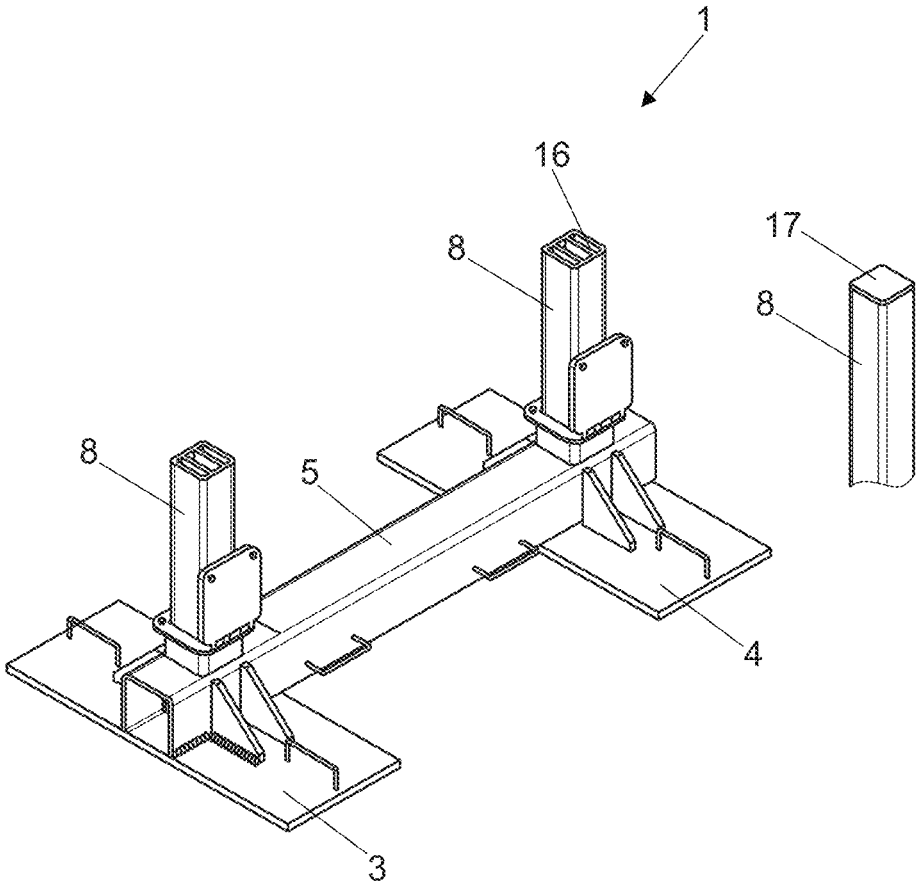
FIG. 6. illustrates an isometric presentation of an embodiment of a security system.

FIG. 6 illustrates an isometric presentation of an embodiment of a security system 1 providing a barrier above a ground level 2 (see FIG. 5). The security system 1 is similar to the system illustrated in FIGS. 1-5.

To increase the strength of the stanchions 8, two stiffening ribs 16 are arranged in the hollow structured formed in the elongated stanchions 8. The stiffening ribs are plate-shaped ribs arranged substantially perpendicular to the third direction. The stiffening ribs 16 extend along the full length of the stanchion 8 in the hollow structure.

An additional stanchion 8 is for illustration arranged next to the security system 1. The additional stanchion 8 comprises a closing cap 17 arranged to hide the hollow structure with the stiffening ribs 16.

Figure 7:
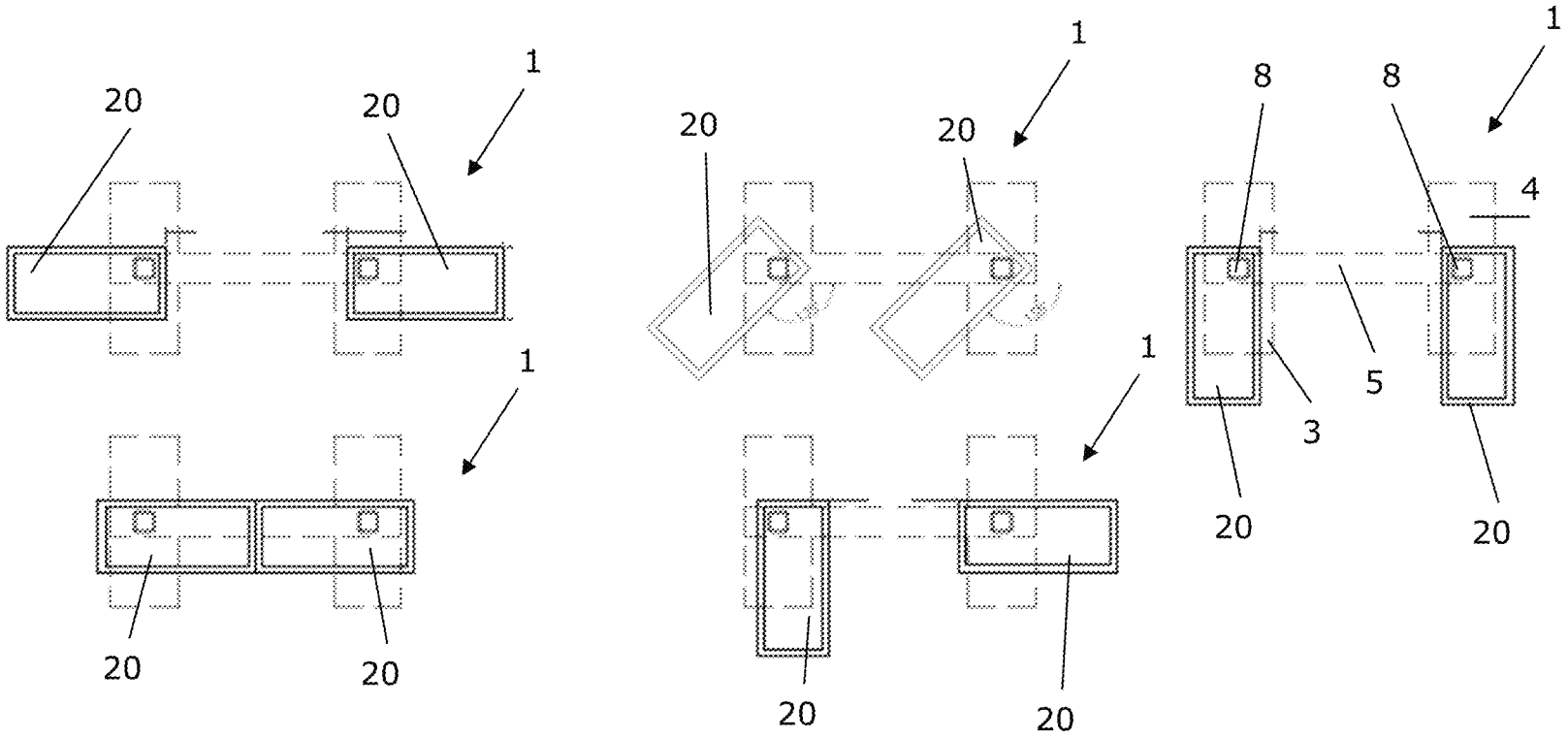
FIG. 7 illustrates top views of an embodiment of a security system with two secondary elements.

FIG. 7 illustrates top views of an embodiment of a security system 1 with two secondary elements 20 in five difference configurations. The security system 1 comprises a first support element 3, a second support 4, an elongated carrier element 5 arranged below ground level (illustrated by the dotted lines) and two upwardly extending stanchions 8, as described above. In the illustrated embodiment, the two secondary elements 20 are in the form of planter trays which are freely arranged around the stanchions 8. In an alternative embodiment (not shown), the security system comprises an attachment structure to allow attachment of the secondary element to the security system. As illustrated in the five different configurations, the secondary elements 20 may form a plurality of layouts.

Figure 8:
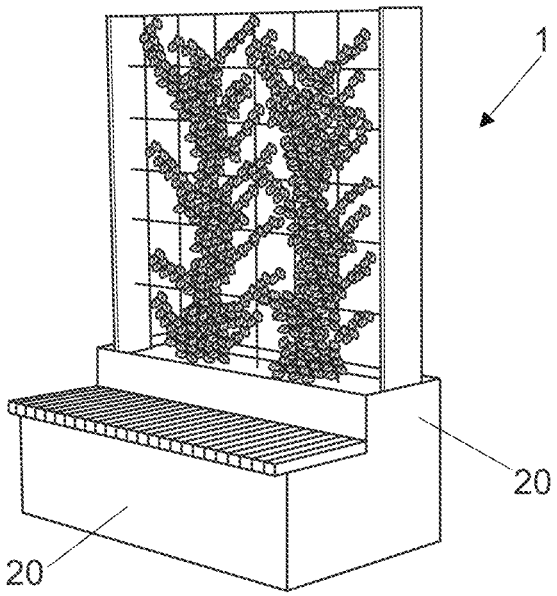
FIG. 8 illustrates an embodiment of a security system with one secondary element.

FIG. 8 illustrates an embodiment of a security system 1 with one secondary element 20. The security system 1 comprises a first support element 3, a second support 4, an elongated carrier element 5 arranged below ground level (not shown in this figure as these elements are below ground level) and two upwardly extending stanchions 8 (not shown). The stanchions 8 are inside the secondary element 20 formed as a plater tray with an integrated bench unit arranged along an outer surface of the planter tray 20 and attached hereto.

Figure 9:
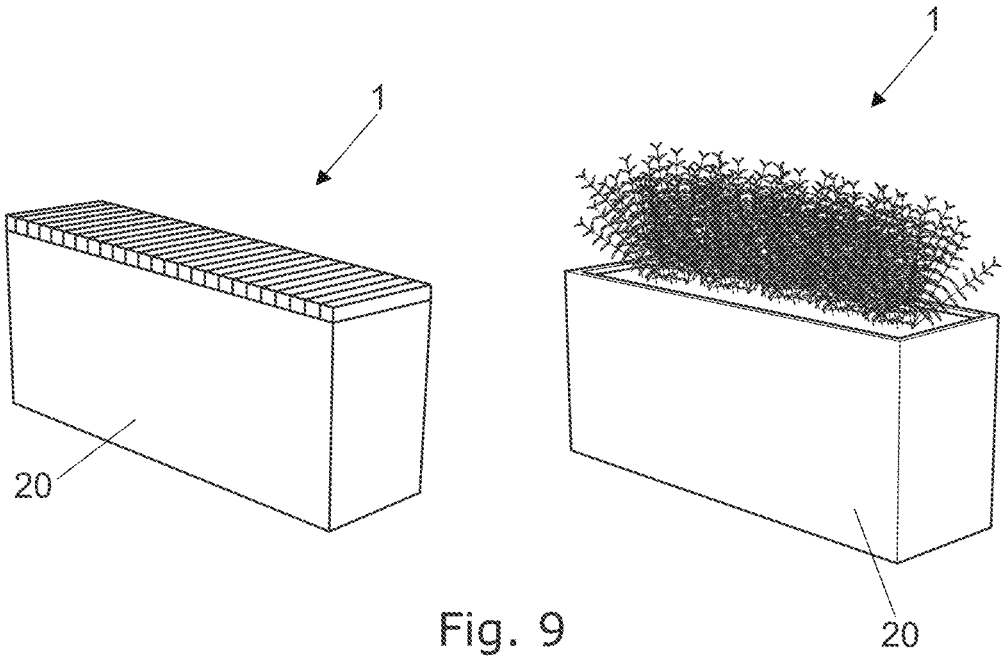
FIG. 9 illustrates two embodiments of a security system, each with a secondary element.

FIG. 9 illustrates two embodiments of a security system 1, each with a secondary element 20. Both security systems 1 comprise a first support element 3, a second support 4, an elongated carrier element 5 arranged below ground level (not shown in these figures as these elements are below ground level) and two upwardly extending stanchions 8 (not shown). In the left side configuration, the stanchions 8 are inside a secondary element 20 formed as a bench unit, and in the right-side configuration, the stanchions 8 are inside a secondary element 20 formed as a plater tray.

Figure 10:
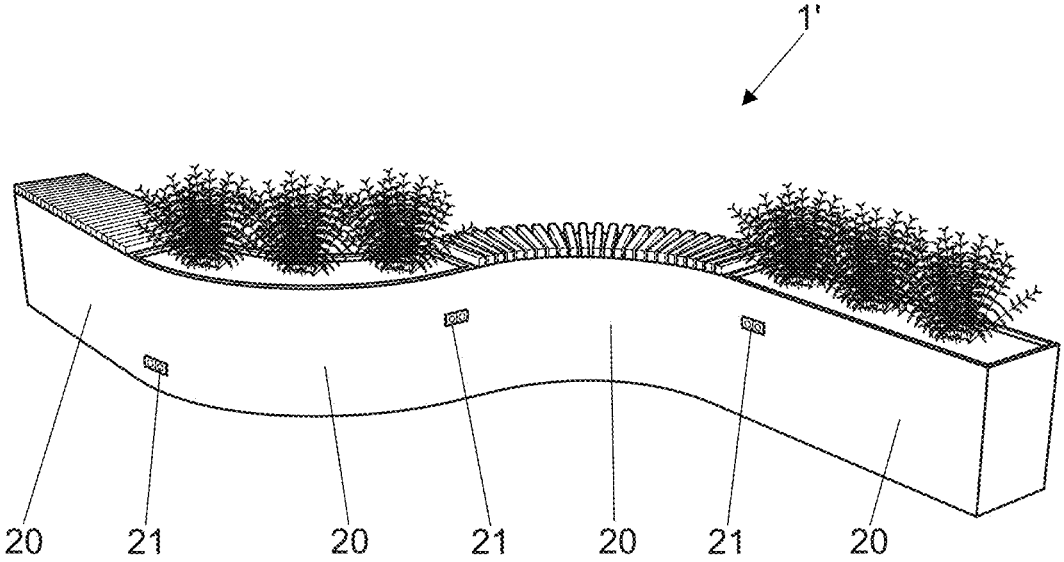
FIG. 10 illustrates a security installation comprising a plurality of security systems with secondary elements.

FIG. 10 illustrates a security installation 1' comprising a plurality of security systems 1 with secondary elements 20. Each of the four security systems 1 comprises a first support element 3, a second support 4, an elongated carrier element 5 arranged below ground level (not shown in this figure as these elements are below ground level) and two upwardly extending stanchions 8 (not shown). The stanchions 8 are inside secondary elements 20 formed as bench units and plater trays. Lighting units 21 are integrated in some of the secondary units 20.

Figure 11:
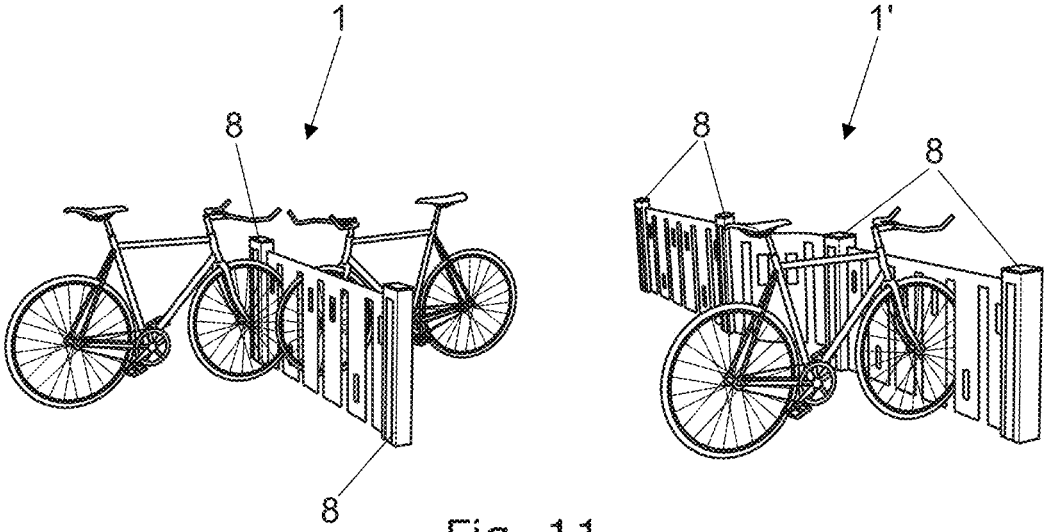
FIG. 11 illustrates an embodiment of a security system with a secondary element, and a security installation comprising a plurality of security systems with secondary elements.

FIG. 11 illustrates an embodiment of a security system 1 with a secondary element 20, and a security installation 1' comprising two security systems 1 with secondary elements 20. Each of the three security systems 1 comprises a first support element 3, a second support 4, an elongated carrier element 5 arranged below ground level (not shown in these figures as these elements are below ground level) and two upwardly extending stanchions 8. The stanchions 8 comprise an attachment structure (not shown) to allow attachment of the secondary elements 20 to the security system. In the illustrated embodiments, the secondary elements 20 are in the form of bike racks.

The invention claimed is:

1. A security system providing a barrier above a ground level, the security system comprising:

a first support element extending in a first direction;

a second support element extending in a second direction, the first support element and the second support element being substantially flat elements, and being arranged below ground level;

an elongated carrier element extending in a third direction, the third direction being transverse to the first direction and the second direction, wherein the first support element and the second support element are attached to a lower surface of the elongated carrier element to provide support for the elongated carrier element, both the first support element and the second support element extending away from the elongated carrier element on opposite sides of the elongated carrier element, the elongated carrier element being substantially box-shaped, and having a carrier thickness being a distance from the lower surface being attached to the first and second support elements to an opposite upper surface of the elongated carrier element, a carrier width being transverse to the carrier thickness, and a carrier length along the third direction, the carrier length being transverse to the carrier thickness and carrier width, the elongated carrier element being arranged below ground level; wherein the first support element, the second support, and the elongated carrier element are covered by at least one cover material; and at least one elongated stanchion extending upwardly from an upper surface of the elongated carrier element from a point below ground level to a point above ground level, wherein the at least one stanchions is removably attached to the elongated carrier element.

2. The security system according to claim 1, wherein the first direction and the second direction are substantially parallel.

3. The security system according to claim 1, wherein the first and second support elements have a support thickness being a distance from a lower surface facing downwards to an upper surface facing upwards at which the elongated carrier element is attached, a support width being transverse to the support thickness, and a support length along the first direction and/or the second direction, the support length being transverse to the support thickness and support width, and wherein the support length is at least twice the support width.

4. The security system according to claim 3, wherein the support width is at least ten times the support thickness.

5. The security system according to claim 1, wherein the carrier length is at least five times the carrier width.

6. The security system according to claim 1, wherein the carrier width is in the range of 0.5-1.5 the carrier thickness.

7. The security system according to claim 1, wherein the at least one elongated stanchion is substantially box-shaped, the elongated stanchion having a stanchion thickness being a dimension in the first direction, a stanchion width being transverse to the first direction, and a stanchion length being transverse to the stanchion thickness and stanchion width, and wherein the stanchion length is at least three times the stanchion width.

8. The security system according to claim 7, wherein the stanchion width is in the range of 0.4-1.8 the stanchion thickness.

9. The security system according to claim 1, wherein the at least one elongated stanchion is formed as a hollow structure with a wall thickness of at least 10 mm.

10. The security system according to claim 9, wherein at least one stiffening rib is arranged in the hollow structured formed by the at least one elongated stanchion, the at least one stiffening rib being a plate-shaped rib arranged transverse to the third direction.

11. The security system according to claim 10, wherein the at least one stiffening rib extend along the stanchion length from a bottom part of the stanchion to a top part of the stanchion.

12. The security system according to claim 1, wherein the elongated carrier element is formed as a hollow structure with a wall thickness of at least 10 mm.

13. The security system according to claim 1, wherein at least two openings are formed in the upper surface of the elongated carrier element, and wherein a bottom end of one of the at least one elongated stanchion is inserted in one of the at least two openings.

14. The security system according to claim 1, wherein at least one protrusion is formed at an outer surface of the elongated carrier element, the at least one protrusion extending transverse to the third direction.

15. The security system according to claim 1, wherein the first support element and the second support element comprise upwardly extending stiffening elements, the stiffening elements being arranged to engage an outer surface of the elongated carrier element to reinforce a joint between the elongated carrier element and the first and second support elements, respectively.

16. A security assembly for use in a security system according to claim 1, the security assembly comprising:

a first support element being a substantially flat element;

a second support element being a substantially flat element;

an elongated carrier element configured for attachment to the first support element and the second support element at a lower surface of the elongated carrier element; the elongated carrier element being substantially box-shaped, and having a carrier thickness being a distance from the lower surface configured for attachment to the first and second support elements to an opposite upper surface of the elongated carrier element, a carrier width being transverse to the carrier thickness, and a carrier length along the third direction, the carrier length being transverse to the carrier thickness and carrier width, and at least one elongated stanchion configured for attachment to an upper surface of the elongated carrier element to extend upwardly from the upper surface, wherein the at least one stanchion is configured for removable attachment to the elongated carrier element.

17. The security assembly according to claim 16, further comprising at least one additional elongated stanchion, the additional elongated stanchion having a different strength than the at least one elongated stanchion to thereby provide a security system with variable strength.

18. A method of constructing a barrier above ground by use of a security system according to claim 1; the method comprising the step of:

providing a first support element, a second support element, the first and second support elements being substantially flat elements, and an elongated carrier element, the elongated carrier element being substantially box-shaped, and having a carrier thickness being a distance from a lower surface to an opposite upper surface of the elongated carrier element, a carrier width being transverse to the carrier thickness, and a carrier length along the third direction, the carrier length being transverse to the carrier thickness and carrier width;

arranging the first support element to extend in a first direction, arranging the second support element to extend in a second direction, and arranging the elongated carrier element to extend in a third direction being transverse to the first direction and the second direction;

attaching the first support element and the second support element to the lower surface of the elongated carrier element so that both the first support element and the second support element extend away from the elongated carrier element on opposite sides of the elongated carrier element;

arranging the first support element, the second support element, and the elongated carrier element below ground level;

providing at least one elongated stanchion;

removably attaching the at least one stanchion to the elongated carrier element so that the at least one stanchion extends upwardly from an upper surface of the elongated carrier element from a point below ground level to a point above ground level; and covering the first support element, the second support element, and the elongated carrier element by at least one cover material.

* * * * *